US005106231A

United States Patent [19]

Thomann

[11] Patent Number: 5,106,231

[45] Date of Patent: Apr. 21, 1992

[54] DRAINAGE CHANNEL HAVING IMPROVED COPING FOR RECEIVING GRATE

[75] Inventor: Roland Thomann, Langnau, Switzerland

[73] Assignee: ABT, Inc., Troutman, N.C.

[21] Appl. No.: 731,345

[22] Filed: Jul. 15, 1991

Related U.S. Application Data

[63] Continuation of Ser. No. 469,100, Jan. 24, 1990, abandoned.

[30] Foreign Application Priority Data

Jan. 31, 1989 [CH] Switzerland ..... 309/89

[51] Int. Cl.[5] ..... E01C 11/22; E01F 5/00

[52] U.S. Cl. ..... 405/119; 405/118; 405/36; 404/2; 404/4

[58] Field of Search ..... 405/118–122, 405/43, 45, 48, 51, 124; 403/2–5, 8, 25

[56] References Cited

U.S. PATENT DOCUMENTS

| | | | |
|---|---|---|---|
| 2,564,386 | 8/1951 | Webb | 52/823 X |
| 3,212,267 | 10/1965 | Biehn | 405/118 |
| 3,308,727 | 3/1967 | Hurt, Jr. | 404/25 X |
| 3,416,282 | 12/1968 | Daugherty | 52/823 X |
| 3,625,011 | 12/1971 | Stevenson | 404/2 X |
| 4,242,848 | 1/1981 | Schoultz | 52/823 X |
| 4,472,078 | 9/1984 | Karbstein | 405/119 X |
| 4,498,807 | 2/1985 | Kirkpatrick et al. | 404/4 X |
| 4,535,756 | 8/1985 | Rinehart et al. | 52/823 X |
| 4,594,157 | 6/1986 | McGowan | 404/4 X |
| 4,621,939 | 11/1986 | Thomann et al. | 404/5 X |
| 4,630,962 | 12/1986 | Thomann et al. | 404/2 |
| 4,630,966 | 12/1986 | Karbstein | 405/118 |
| 4,640,643 | 2/1987 | Williams | 405/118 X |
| 4,650,365 | 3/1987 | Runnels | 404/4 X |
| 4,699,544 | 10/1987 | Karbstein | 405/118 |

FOREIGN PATENT DOCUMENTS

| | | | |
|---|---|---|---|
| 0210117 | 11/1984 | Japan | 405/118 |

*Primary Examiner*—Dennis L. Taylor

*Attorney, Agent, or Firm*—Bell, Seltzer, Park & Gibson

[57] ABSTRACT

A drainage channel comprising a channel body which is U-shaped in cross-section and defines a concave base and integrally formed opposing first and second vertically spaced-apart side walls, the first and second side walls including respective crowns formed in upper free ends of the side walls. The upper free end of the side walls define a predetermined thickness between respective inner side wall surfaces and outer sidewall surfaces. The outer surfaces of the side walls define an elongate detent spaced below the upper free ends of the first and second side walls and extending along at least part of the length of the channel body and defining an area of reduced thickness below the relatively thicker free ends of the first and second side walls. A coping encloses the crown of a respective side of the channel body. The coping includes an inner leg for resting against the inner side wall surfaces of the channel and an outer leg for resting against the outer side wall surfaces of the channel. The outer leg has an elongate rib of enlarged dimension on a free end of the outer leg for being received by means of a snap fit over the relatively thick free end of the side wall into the detent.

12 Claims, 2 Drawing Sheets

DRAINING CHANNEL HAVING IMPROVED COPING FOR RECEIVING GRATE

This application is a continuation, of application Ser. No. 07/469,100, filed Jan. 24, 1990, now abandoned.

FIELD OF THE INVENTION

The invention relates a drainage channel of the type adapted to be set into a surface and which includes a coping for receiving a grating to cover the open top of the drainage channel.

BACKGROUND OF THE INVENTION

Drainage channels are known means for draining water from the surfaces of squares and public roads. Pre-fabricated conduits under the surface are cast in a concrete berm. Gratings made of shaped plates provided with slots or of cast iron are used as covers. It is customary to design the crowns of the side walls so that they can receive and retain these gratings. This can be accomplished either with a projecting rib made of the material or by means of a frame placed on the channels. The channel are now often made of polyester concrete.

It is known that the crowns of the side walls must be, for this reason, practically twice as thick as the lower part in order to give them the necessary strength.

In order to avoid using this additional material, which sharply increases the costs of the channels, German Patent 3 149 552 suggests mounting a metal frame on the channel walls and anchoring it therein. A further solution along these lines is described in German Registered Design (Utility Model) 84 35 101, which suggests using a shaped sheet-metal part instead of an expensive shaped strip with anchoring openings on both sides, which can be penetrated by the casting material. With this shaped part, the blank is folded around a fold line to form a double-layer side leg for lateral clamping of the gratings. One of the two layers forms the outer retaining leg, and the other forms the inner retaining leg after double folding. The two retaining legs are provided with anchoring clasps directed toward each other in order to form a rigid connection for the channels with the casting material.

Since this kind of edge protection is placed in the mold before casting of the channel, and the channel is removed after setting of the casting material, it is seen that shrinkage of the casting material and these rigid edge protection shapes can cause buckling of the channels, which cannot be used without reworking.

It is therefore an object of the invention to devise an edge protection for drainage channels, which will not cause any warping of the channels, but will result in a neat and satisfactory bearing and recess for the gratings in the pavement of the roadway or square.

SUMMARY OF THE INVENTION

The invention is directed to copings for a drainage channel of the type adapted to be set into a surface, having an open top, and being of generally U-shaped cross-section including a closed base and upwardly extending side walls terminating in upper free ends. The coping advantageously comprises a pair of elongate members which are adapted for mounting on the upper free ends of the side walls and for receiving a grate for covering the top end top of the channel body. Each of the elongate members includes a pair of spaced apart downwardly directed inner and outer retaining legs which are adapted to rest against the inner and outer faces, respectively, of the side walls. The outer leg of each elongate member terminates in a free end which includes an inwardly directed elongate rib of enlarged dimension. An anchoring means for receiving the elongate rib of the outer leg of the coping member is formed in the outer face of each of the side walls of the channel body. The anchoring means includes an area of reduced side wall thickness integrally formed in the outer face of the side wall and spaced below the upper free end thereof. The anchoring means can be a longitudinal groove in the outer face of the side wall, or can be an area of reduced side wall thickness below a thickened, upper crown portion of the side wall. Advantageously, the coping members of the present invention are formed of a plastic material.

BRIEF DESCRIPTION OF THE DRAWINGS

The invention is explained with reference to the drawings in which.

DETAILED DESCRIPTION OF THE PREFERRED EMBODIMENT

Figure 1:
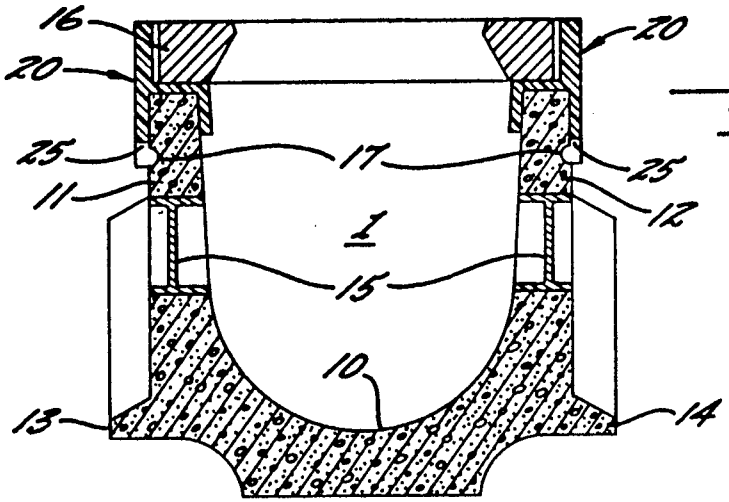
FIG. 1 is a sectional view of a drainage channel with mounted coping according to the invention and inserted grating along the line I—I in FIG. 2.
Figure 2:
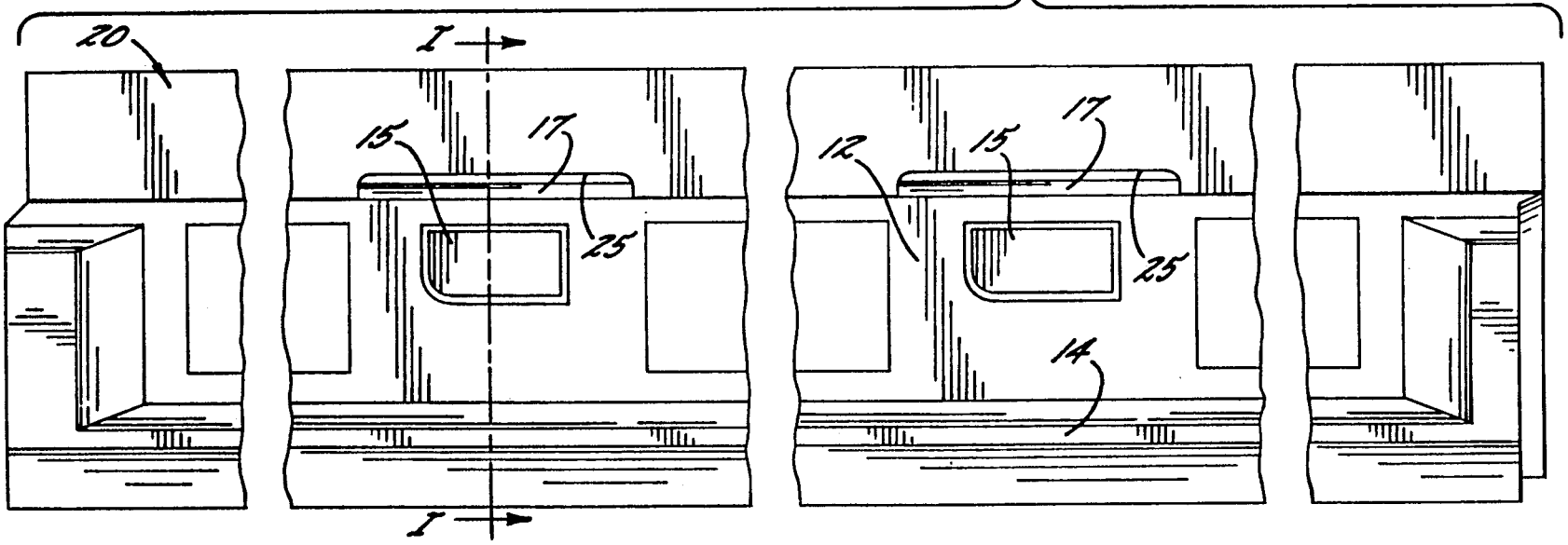
FIG. 2 is an elevation of the drainage channel.

The drainage channel 1 according to FIG. 1 and 2 is a U-shaped conduit with a concave base 10 and side walls 11, 12. The inside faces of the side walls are angled outwardly in the direction from bottom to top while the outside faces are parallel to each other and substantially perpendicular to the bottom of the channel. Thus, the side walls gradually decrease in thickness from bottom to top resulting in a narrower top end side wall surface and in various advantages including a considerable savings in material.

The outwardly projecting ribs 13, 14 with horizontal bottom and outwardly angled surfaces provide a solid anchoring of the drainage channel 1 in the concrete berm, so that the draining channel cannot be lifted up under freezing conditions. It can be seen in FIG. 2 that these ribs 13, 14 extends along the entire length of the channel wall. They can also be interrupted at certain points, however.

A lock is indicated left and right in FIG. 2 with a female part on the right and a male part on the left for aligning channels in sequence on each other so that there can be no disturbing offsets at the base or at the upper channel wall.

Bar holder boxes 15 are set in the side walls 11, 12. Such bar holder boxes 15 serve for bolting of the gratings 16; a bar (not shown) engages the upper walling from below and can be seduced by a bolt coming from the grating. These bar holder boxes are described in EP-B-O 112 287 and need not be discussed in detail here.

The present invention relates to the coping 20, which is designed as a shape in the form of an "h", and has a straight outer wall 21 with an inwardly directed rib 24, a support 22 at right angles with said outer wall 21, and an inner leg 23. As FIG. 4 shows, the outer wall 21 is inclined by an angle $\alpha$ of 1 to 5 degrees, that is, the section 25 is angled toward the inner leg 23 in order to produce prestressing on the side wall 11, 12 of the drainage channel 1.

Figure 3:
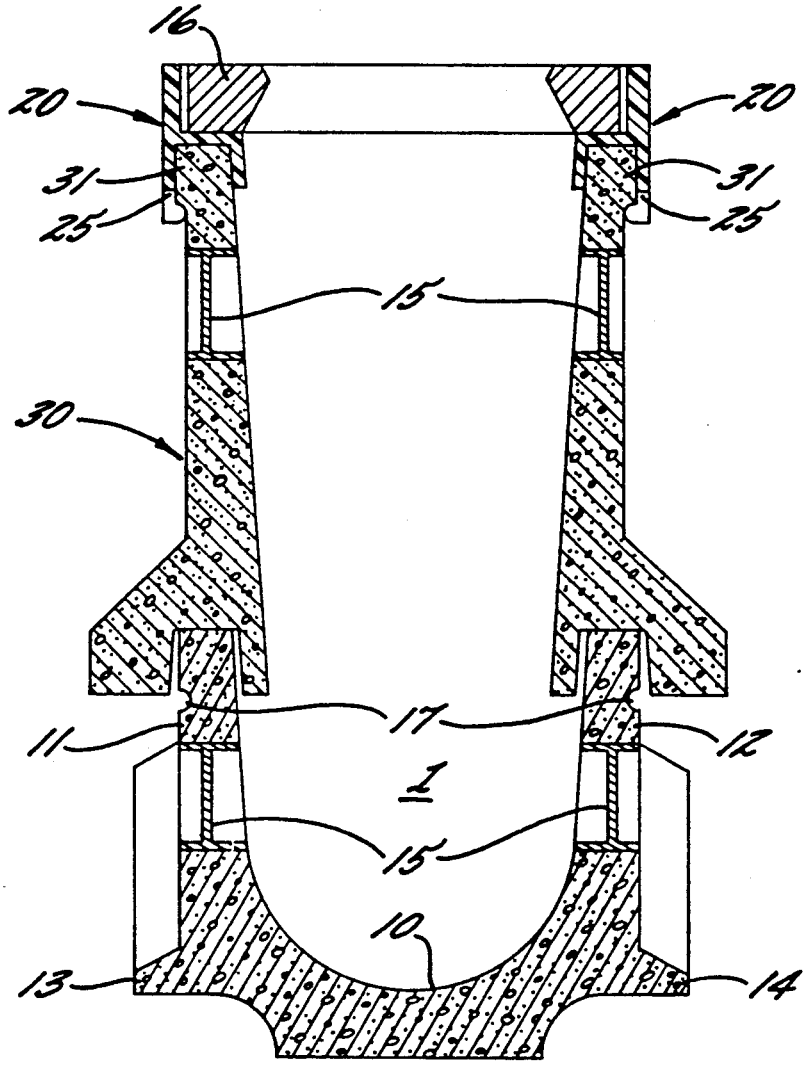
FIG. 3 is a sectional view as in FIG. 1 but with a mounting component for increasing the height of the channel.
Figure 4:
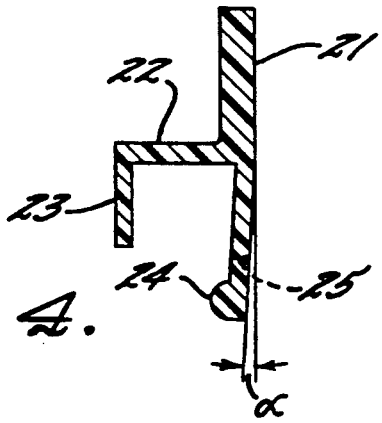
FIG. 4 is a sectional view of the coping.

For anchoring the coping 20, the side walls can have a longitudinal groove 17, as shown in FIG. 1 to 3, or a crown thickening 31 with the mounting component 30 according to FIG. 4. Viewed from the side, the coping 20 has cutouts 25 in the area of the bar holder boxes 15. They could also be arranged elsewhere or there can be more then just the two cutouts 25 seen in FIG. 2. They serve for clamping in the concrete berm or pavement with which they dovetail to secure against longitudinal displacement.

The advantages of this kind of coping over the known copings mentioned are obvious. In particular, this kind of coping can be mounted wither before or just after casting of the drainage channel in the berm. For this reason, there is no need to pay attention to shrinkage in setting. The drainage channel can thus be fabricated in accordance with the known manufacturing specifications for polyester concrete for example.

The coping itself will preferably be made of plastic, for example, extrudable plastics such as thermoplastics that are unaffected by changes within the range of ground temperatures. The latter have advantages over metal frames that cannot be cut or that can rust if they have to be fitted. However, it is also important that the invented copings lie flush against the channel wall so that no condensation water can form between the coping and the side wall. In particular, there are no capillary structure as in the folded sheet-metal described in the aforementioned Utility Model 84 35 101, hence there is no risk of rusting through.

A further advantage in the use of plastic is that the gratings 16 now lie together with the bar holder boxes 15 on plastic and the bares are pressed against the plastic of the bar holder boxes 15. Spontaneous loosening of the bolts is thus practically impossible, but even if a bolt were not tightened properly, a grating lying on plastic would not rattle.

One more advantages in that the crowns of the side walls can be produced without thickening and without steps for receiving gratings or their frames, which means a quite considerable savings in material.

I claim:

1. A drainage channel comprising:

(a) a channel body adapted to be set into a surface, said channel being U-shaped in cross-section and having a concave base and integrally formed opposing first and second vertically spaced-apart side walls terminating in upper free ends;

(b) crowns formed in an upper portion of each of said side walls, said crowns comprising the upper free ends of the side walls, said upper free ends being of a predetermined thickness between respective inner side wall surfaces and outer side walls surfaces and an elongate area of lesser thickness than said predetermined thickness in said outer side wall surfaces, said elongate area being spaced below the upper free ends of the first and second side walls and extending along at least part of the length of the outer surface of the channel body side walls; and (c) a coping for enclosing the crown of a respective side wall of the channel body, the coping including a downwardly facing inner leg for resting against the inner side wall surfaces of the channel, a downwardly facing outer leg for resting against the outer side wall surfaces of the channel and a member connecting upper portions of said inner and outer legs for covering the upper free end side wall surfaces of the channel body, said outer leg terminating in a free end comprising an elongate rib of enlarged dimension, said rib being adapted for being received by said elongate area of reduced thickness of said side wall whereby said coping can be anchored to said side wall by means of a snap fit onto said crown of said wall.

2. A drainage channel according to claim 1 wherein said coping is fabricated of plastic.

3. A drainage channel according to claim 1 wherein said coping is h-shaped in cross-section.

4. A drainage channel according to claim 1 wherein, before application of the coping to the drainage channel at least one of the inner and outer legs of the coping converge towards respective free ends thereof to provide a more secure snap fit of the rib of the coping into the detent of the channel body.

5. A drainage channel according to claim 1 wherein said elongate area of lesser thickness on said outer side wall surfaces comprises a longitudinal groove.

6. A drainage channel according to claim 5 wherein the detent defines a radius with reference to the relatively thicker free ends, and wherein the rib of the coping includes a radius sized and shaped to mate with the radius of the longitudinal groove when in place on the channel body.

7. A drainage channel comprising:

an open top channel body adapted to be set into a surface and being of generally U-shaped cross-section comprising a closed base and upwardly extending side walls terminating in upper free ends;

a pair of elongate coping members adapted to be mounted on the upper free ends of said side walls for receiving a grate for covering the open top of said channel body, each of said elongate coping members comprising a pair of spaced apart downwardly directed inner and outer retaining legs adapted to rest against the inner and outer faces, respectively, of said side walls, said outer leg terminating in a free end comprising an inwardly directed elongate rib; and anchoring means formed in the outer face of each of said side walls for receiving said elongate rib of said outer leg of said elongate coping member, said anchoring means comprising an elongate area of reduced size wall thickness integrally formed in the outer face of each of said side walls and spaced below the upper free end thereof.

8. The drainage channel defined in claim 7 wherein each of said elongate coping members is fabricated of plastic.

9. The drainage channel defined in claim 8 wherein each of said elongate coping members has a generally h-shaped cross-section.

10. The drainage channel defined in claim 9 wherein, prior to application of the elongate coping members to the side walls of the drainage channel, at least one of the downwardly directed inner and outer legs of the elongate coping members converges in the downward direction towards the other leg thereof to thereby provide for snap fitting of said elongated coping member onto the side wall of said drainage channel body.

11. A drainage channel according to claim 10 wherein said anchoring means formed in the outer face of each of said side walls comprises a longitudinal groove.

12. A drainage channel according to claim 10 wherein said anchoring means formed in the outer face of each of said side walls comprises a thinner portion foe each of said walls disposed below a thickened upper crown portion of each of said side walls.

* * * * *

UNITED STATES PATENT AND TRADEMARK OFFICE

CERTIFICATE OF CORRECTION

PATENT NO. : 5,106,231

DATED : April 21, 1992

INVENTOR(S) : Thomann

It is certified that error appears in the above-identified patent and that said Letters Patent is hereby corrected as shown below:

Column 3, line 38, delete "advantages" and insert -- advantage --.

Column 4, line 43, delete "size" and insert -- side --.

Column 4, line 66, delete "foe" and insert -- of --.

Signed and Sealed this

Thirtieth Day of November, 1993

Bruce Lehman

*Attest:*

BRUCE LEHMAN

*Attesting Officer*

*Commissioner of Patents and Trademarks*